US007681548B2

(12) United States Patent
Aamand

(10) Patent No.: US 7,681,548 B2
(45) Date of Patent: Mar. 23, 2010

(54) METHOD AND APPARATUS FOR LUBRICATING CYLINDER SURFACE IN LARGE DIESEL ENGINES

(75) Inventor: Jan Aamand, Haderslev (DK)

(73) Assignee: Hans Jensen Lubricators A/S, Hadsund (DK)

( * ) Notice: Subject to any disclaimer, the term of this patent is extended or adjusted under 35 U.S.C. 154(b) by 316 days.

(21) Appl. No.: 11/630,635

(22) PCT Filed: Jun. 30, 2005

(86) PCT No.: PCT/DK2005/000445

§ 371 (c)(1),
(2), (4) Date: Mar. 8, 2007

(87) PCT Pub. No.: WO2006/002632

PCT Pub. Date: Jan. 12, 2006

(65) Prior Publication Data

US 2008/0066712 A1 Mar. 20, 2008

(30) Foreign Application Priority Data

Jun. 30, 2004 (DK) ..... 2004 01035

(51) Int. Cl.
*F01M 1/08* (2006.01)
*F01M 1/14* (2006.01)

(52) U.S. Cl. ..... 123/196 R; 123/196 M; 184/6.8

(58) Field of Classification Search ..... 123/196 R, 123/196 M; 184/6.8, 18
See application file for complete search history.

(56) References Cited

U.S. PATENT DOCUMENTS

| | | | | |
|---|---|---|---|---|
| 5,655,495 | A * | 8/1997 | Richards | 123/196 S |
| 2003/0230274 | A1 * | 12/2003 | Williams et al. | 123/196 R |
| 2004/0026174 | A1 * | 2/2004 | Lauritsen | 184/6.8 |

FOREIGN PATENT DOCUMENTS

| | | |
|---|---|---|
| DE | 2827626 | 10/1979 |
| DK | 169589 | 12/1994 |
| WO | WO 00/28194 | 5/2000 |
| WO | WO 02/35068 | 5/2002 |
| WO | WO 02/35068 A1 * | 5/2002 |

* cited by examiner

*Primary Examiner*—Noah Kamen
(74) *Attorney, Agent, or Firm*—James Creighton Wray; Meera P. Narasimhan

(57) ABSTRACT

There is described a method and an installation for lubricating cylinder surfaces 6 in large diesel engines. The installation includes a lubricating apparatus 3 with a number of piston pumps 4 which via connecting lines 5 are connected with lubricating points 6 in the cylinder walls 7. In order to enable electronically controlled regulation of the lubricating oil portion, there is provided an electronic control unit 9 which is connected with a flow regulator 8. The flow regulator includes redirecting valves 12 which are inserted in connecting lines 5 between the lubricating apparatus 3 and the lubricating points 6.

16 Claims, 3 Drawing Sheets

METHOD AND APPARATUS FOR LUBRICATING CYLINDER SURFACE IN LARGE DIESEL ENGINES

BACKGROUND OF THE INVENTION.

This application claims the benefit of Danish Application No. PA 2004 03035filed Jun. 30, 2004and PCT/DK2005/000445filed Jun. 30, 2005, which are hereby incorporated by reference in their entirety.

The present invention concerns a lubricating system that includes a method and an installation for lubricating the cylinder faces in large diesel engines, particularly marine engines, including at least one lubricating apparatus with a number of piston pumps which via connecting lines are connected with and feed various lubricating points disposed in the walls of the cylinders.

The lubricating apparatuses are traditionally designed as pumping units which are mounted in close association with respective cylinders, and which are connected with a feeding reservoir for lubricating oil and with lubricating points in the form of oil injection nozzles at different points on the cylinder wall. Each pump unit includes a plurality of piston pumps that feed various lubricating points with oil, and which are driven by a common rotating control shaft with cams applied thereon. At the rotation of the shaft, the cams with pressing heads act on respective axially displacing pistons which are spring biased in direction towards the control shaft, so that the pistons at the rotation of the shaft will perform reciprocating movements for activating the pistons of the piston pumps.

For many years, lubricating apparatuses have operated under the condition that the discharge pressure from the piston pumps was not to be very great, as it is a fixed standard that the oil is to be injected into the cylinder during the upwards return stroke of the engine piston, i.e. during the compressing action, however before the subsequent power stroke by the ignited combustion. Hereby, it has been necessary to operate with injection or pump pressures of the magnitude 10 bar.

In recent years it has been proposed to increase the efficiency of the lubrication by injecting the oil through pressurised atomising nozzles for achieving oil mist lubrication during the upwards movement of the piston. However, hereby the oil is applied a far higher pressure for ensuring fine atomisation through atomising nozzles, e.g. a pressure up to 100 bar or more.

Lubricating points will thus, as mentioned in the present application, include oil injecting nozzles and/or pressurised atomising nozzles.

In both systems, the control shaft is driven through a direct or indirect mechanical coupling with the crankshaft of the engine, whereby it is possible to provide power for the activation of pumps and at the same time to achieve synchronisation between the crankshaft of the engine and the control shaft of the lubricating apparatus.

A pump unit may e.g. include a box-shaped apparatus housing, from where connecting pipes extend to the lubricating points on the associated engine cylinder, e.g. in a number of 6-24.

The pistons are traditionally operated by means of activation cams/rocker arms on a through-going control shaft which is rotated synchronously with the crankshaft of the engine. The pistons are spring biased towards the activation cams. There is provided a set screw defining the extreme position of an associated activation cam. The set screws may be operated for determining individual operative strokes of the pistons and thereby the associated yield of the individual piston pumps.

By lubrication according to the invention, it is possible for the user to operate with controlling injection timing for a synchronised lubrication, which is timed according to the rotation of the crank, or unsynchronised cylinder lubrication, i.e. a cylinder lubrication that does not depend on the rotation and angular position of the crank.

Furthermore, there is an increasing demand for a flexible and easy adjusting of the controlled feeding cylinder lubrication oil portion for the immediate demand of the engine depending on diverse measurable engine parameters. It is also desirable to adjust the timing concurrently with the actual operating situation of the engine in a flexible way. All these adjustments are preferably to be controlled centrally.

Driving the lubricating apparatuses synchronously with the engine speed is electronically feasible, but extensive and costly. With such a system, the timing can be changed immediately. Changing the fed cylinder lubricating oil portion is, however, more difficult to control.

As the cylinder lubricating oil is to be dosed with one portion per engine revolution, the only possibility of adjusting the dosage is to change the stroke of the pumps. A system for this purpose is e.g. described in DK patent application 4998/85. This system is operated by a cam disk mechanism for adjusting the pump stroke in dependence on the engine load. Changing this dependence may only be effected by changing the cam disks with other cam disks with a different transfer function.

It has also been proposed to adjust the pump stroke by means of a controllable motor, e.g. a step motor. This has been used for point lubrication, but it is difficult to establish in connection with conventional lubricating apparatuses. Such a system is e.g. disclosed in International Patent Application no. WO 02/35068 A1.

Moreover, from DE 28 27 626 is also known a lubricating system based on lubricating oil being supplied in measured quantities at predetermined time intervals through apertures in the cylinder wall. There is no indication here of stepless control of the dosage to be performed at individual lubricating points.

In connection with traditional cylinder wall lubrication, it has hitherto been the practice to use simple spring-biased check valves that can resist the internal pressure in the cylinder, but which yield to a slightly higher external injection pressure. However, in connection with pressurised atomised injection, it is desirable and necessary that the valve system opens only at a much higher oil pressure in order that the oil injection can assume the character of a pressurised atomising injection right from the beginning. We are hereby speaking of a pressure differential factor of up to several hundred percent.

SUMMARY OF THE INVENTION

It is the purpose of the present invention to indicate an installation and a method whereby it is possible to establish the cylinder lubrication in a way whereby it is possible to achieve a flexible, electronically controlled, central stepless control of the feeding to individual lubricating points and precise control of the timing.

According to the present invention, this is achieved by a method of the kind mentioned in the introduction which is peculiar in that the lubricating oil portion from a specific pump stroke and to a specific lubricating point is returned to the lubricating apparatus, as an electronic controlled redirecting of the lubricating oil portion between lubricating apparatus and the lubricating points is established.

The installation according to the invention is peculiar in that it includes an electronic control unit which is connected with a flow regulator that includes redirecting valves which are inserted in connecting lines between the lubricating apparatus and the lubricating points.

With a method and an installation according to the invention, it is possible to reduce the lubricating oil portion according to different regulating principles which are determined by an electronic control. As the electronic control is used for redirection of the lubrication oil portion between the lubricating apparatus and one of the lubricating points in one or more of the cylinders, a relatively simple solution is provided. By this solution a stepless adjusting of the lubricating oil amount fed to each cylinder in a single pump stroke for the lubricating apparatus may be attained in an electronically controlled way.

It is thus possible in succeeding pump strokes in the lubricating apparatus to perform blocking of a lubricating point in all cylinders, or part of the cylinders, and that by a subsequent pump stroke in the lubricating apparatus blocking of other lubricating points in the cylinders is performed. Hence, cyclical blocking of the various lubricating points of the cylinder may be performed in one cycle.

The system according to the invention may be used for traditional lubrication and for e.g. SIP lubrication. The advantage of the invention and possibilities of saving would be just as attractive irrespective of the lubrication principle.

With the flow regulator it thus becomes possible to regulate the flow at a given number of lubricating points. The number of lubricating points with possibility of flow regulation depends on how flexible a user wants the regulation. With the system according to the invention, automatic shifting between lubricating points, where flow regulation is performed, is ensured.

The flow regulator applied may either be integrated in the lubrication apparatus or be mounted as a separate unit which is associated with existing or new lubricating apparatuses. The system according to the invention is thus advantageous in that it may be retrofitted in existing installations, irrespectively whether these prior art apparatuses are based on oil injection or pressure atomisation.

The flow regulator is controlled by the electronic control so that between the individual lubricating points and depending on actual need and load level, the lubricating oil is redirected to either the lubricating apparatus or to a reservoir for the lubricating oil. In principle, it may be said that regulation is performed by one or more of the lubricating points of the lubrication apparatus being "by-passed" in a lubricating stroke, and the lubrication thereby established over a period of time will enable a stepless adjustment of the portion or amount. This stepless quantitative adjusting occurs independently of the adjustability of the amount and may be combined with adjusting the amount by adjusting the stroke of the piston pumps.

With a flow regulation according to the invention, a programming of the electronic control may be performed. With a lubricating apparatus intended for feeding ten lubricating points, a 10% reduction may thus be effected by a lubricating point is bypassed in each succeeding cycle. After 10 cycles, all the lubricating points would have been bypassed. Irrespective of this bypassing, by using the system according to the invention in each cycle, lubrication of every cylinder is performed. This lubrication will, however, not necessarily occur at every lubrication point of the cylinder.

According to a further embodiment, the method according to the invention is peculiar in that the lubricating oil portion is redirected to the lubricating apparatus or to a lubricating oil reservoir. Hereby is achieved a very simple system as there will be no need of separate containers for receiving the redirected lubricating oil portion.

According to a further embodiment, the method according to the invention is peculiar in that that the lubricating oil portion is alternately redirected between the various lubricating points in different cylinders which are lubricated by using one or more lubricating apparatuses. According to specific embodiments, it is possible to use the flow regulation for controlling one or more lubricating apparatuses, and each of these lubricating apparatuses may be used for feeding a number of lubricating points in one or more cylinders. The invention is thus not limited to using one lubricating apparatus per cylinder and flow regulation that only regulates a single lubricating apparatus.

According to a further embodiment, the method according to the invention is peculiar in that the controlled feeding of oil from the lubricating apparatus is adjusted so that lubrication without redirection of any lubricating oil portion ensures that no under-lubrication occurs by the lubrication of the cylinders. In principle, this corresponds to over-lubricating the cylinders. By this embodiment, it becomes possible to perform regulation so that in principle one may overdose so that in some operational situations it is possible to provide cylinder lubrication, e.g. at reduction of engine speed at a critical time, e.g. by manoeuvring in a harbour. By arranging the oil dosage so that over-lubrication is performed without redirecting the lubricating oil portion, in principle one may say that a "normal operational situation" will always be performed with reduced dosage of the lubricating oil portion in relation to the maximum possible dosage.

However, the invention is particularly advantageous when running in very low engine load ranges, as, compared with engine lubrication without using the invention, a saving of the lubricating oil portion will be attained relative to a traditional cylinder lubrication which is only based on the engine speed.

By using a system according to the invention, it will e.g. be possible to operate with normal lubricating pressure corresponding to 80% of the maximum possible lubricating oil dosage. Hereby, it is possible to provide up to about 20% over-lubrication.

According to a further embodiment, the method according to the invention is peculiar in that the electronically controlled redirecting includes activation of an electromagnetic valve which has an initial setting where the lubricating oil is conducted to the lubricating point, and which by activation is displaced so that the lubricating oil is returned to the lubricating apparatus or to the lubricating oil reservoir. By using an electromagnetic valve, a particularly simple and secure regulation of the oil flow is achieved. In a normal situation, all valves will be supplied and will direct the oil to the lubricating point, however excepting the situation where the system is over dimensioned. Thus there will always be an oil flow to the valves, and this flow is conducted to the lubricating point. When regulation is performed, the electronic control will activate the electromagnetic valve, providing a displacement whereby the lubricating oil will be redirected via the valve and returned to the lubricating apparatus or the reservoir. If the electronic control fails, there will be no risk of engine breakdown but over-lubrication may then occur compared with the wanted lubrication. An electromagnetic valve is not necessarily required for the redirection. Any control valve capable of performing shift of the oil flow may be used.

If desired, the flow regulator may be equipped with an indicator for the accuracy of the electromagnetic valve. Hereby it becomes possible to obtain indication of possible faulty position of electromagnetic valve/lubricating points.

The electromagnetic valve is designed so that the shifting occurs with the least possible disturbing of flow and pressure conditions between lubricating apparatus and lubricating point.

According to a further embodiment, the method according to the invention is peculiar in that redirection of the lubricating oil portion is performed at a time between lubricating strokes of the lubricating apparatus, and that the redirection is preferably initiated by an index signal coming from a completed controlled feeding of lubricating oil from the lubricating apparatus. Hereby is achieved a very simple construction, where no special demands are made to the speed of the electromagnetic valve. By using an index signal for completed feeding of lubricating oil, it will only be required to perform resetting the electromagnetic valve between succeeding lubricating strokes. For example, at 100 revolutions per minute, there may be 600 milliseconds between the lubricating strokes. This will be ample time for resetting the control valve, even when subtracting the time used for activating the control valve.

According to a further embodiment, the method according to the invention is peculiar in that the control is performed based on customised regulating algorithms which are contained in an electronic control unit. Standard programming may be programmed into the electronic control unit, or customer-engineered regulation options may be put into the control program.

Regulation may thus be effected independently of engine revolutions, e.g. based on the index signal from the lubricating apparatus. For controlling the flow regulator, different parameters may thus be used, e.g. actual engine load, signals from lubricating apparatus, pressure conditions, load conditions, customer-specific parameters, e.g. results of analyses of scrape-down, or other parameters. The flow regulator may thus be controlled according to regulating principles, e.g. engine speed (RPM), mean effective pressure (MEP), engine power (BHP) or load change dependent (LCD).

According to a further embodiment, the installation according to the invention is peculiar in that the redirection valves are connected with return lines which are connected with the lubricating apparatus or a lubricating oil reservoir. By connecting the redirecting valves with return lines, the simple construction explained above is achieved, with the possibility of redirecting the lubricating oil portion to the lubricating apparatus or the lubricating oil reservoir.

According to a further embodiment, the installation according to the invention is peculiar in that redirecting valves are provided as electromagnetic valves which may be set in an initial setting where the lubricating oil is conducted to the lubricating point, and an activated setting where the lubricating oil is returned to the lubricating apparatus or the lubricating oil reservoir. The use of electromagnetic valves as advantageous elements for redirection has already been mentioned above. The electromagnetic valve is advantageous as in a non-activated position it can always ensure that lubrication is performed. By using the redirecting valves, it is preferred that the reservoir to which the oil is redirected will be pressurised so that there will be the least possible disturbances in the oil flow.

However, it will be possible to operate with a tank which is not pressurised, but in that situation it is preferred that the valve is provided in a quality so that it is completely tight. Thus there will be no risk of disturbing after-lubrication occurring which may be the case with pressure differences and insufficient tightness in the valve.

Thus it is important that the pressure in the line up to the lubricating point (at least from the redirecting valve) is kept as unaffected as possible. Thus it is to be ensured that a subsequent pumping stroke will always be as precise as possible. This means that the system is to be arranged so as to avoid pressure loss in the connecting line, as hereby there is achieved as exact and delimited lubrication as possible. If pressure loss occurs there will be the risk of influencing the build-up of a lubricating oil spray.

A practical solution to these problems may be inserting a check valve in the connecting line between the electromagnetic valve and the lubricating point.

Though embodiments with magnet valves are described above, alternatively it will be possible to use a shut-off valve. However, it is then to be ensured that the oil is returned to a lubricating apparatus or an oil tank, which means that the redirection is effected by using other means than the redirecting valve itself.

In order to achieve the advantages of the invention it is important that the line to the lubricating point/redirection is shut off.

According to a further embodiment, the installation according to the invention is peculiar in that the redirecting valves are provided with a pump housing and a channel block which are connected to form a single unit containing a slide valve which has an initial setting where the lubricating oil is conducted to the lubricating point, and an activated setting where the lubricating oil is returned to the lubricating apparatus or the lubricating oil reservoir through an activation by air or by a spring. It is also possible to obtain the activation with a build in electromagnetic valve which in an initial setting is closed and which through activation will open and thereby return the lubricating oil. Such valve may be integrated in the pump unit of existing lubricating apparatuses and thus it will easily be adapted. It is also possible to use a build in solenoid valve in which a solenoid coil through activation will open a valve. Due to the integrated construction it is possible to obviate surge in connecting lines.

A system according to the present invention may, as mentioned, be used in connection with various traditional lubricating principles. It may thus be used in connection with traditional lubricating apparatuses or in connection with so-called SIP-lubrication.

It is also possible to use the system according to the present invention together with a so-called load change actuator. In cases where it is desired to e.g. increase the amount of lubrication for all lubricating apparatuses at once, the mechanical load change actuator may be used, as by means of extra electromagnetic valves one may activate an adjustment stop. In practice, extra lubrication is provided for a given period of time.

It is also possible to use the system according to the invention in connection with lubrication effected with timing, or in connection with lubrication effected without timing.

The invention will now be explained more closely with reference to the accompanying drawing, where:

DETAILED DESCRIPTION OF THE PREFERRED EMBODIMENTS

Figure 1:
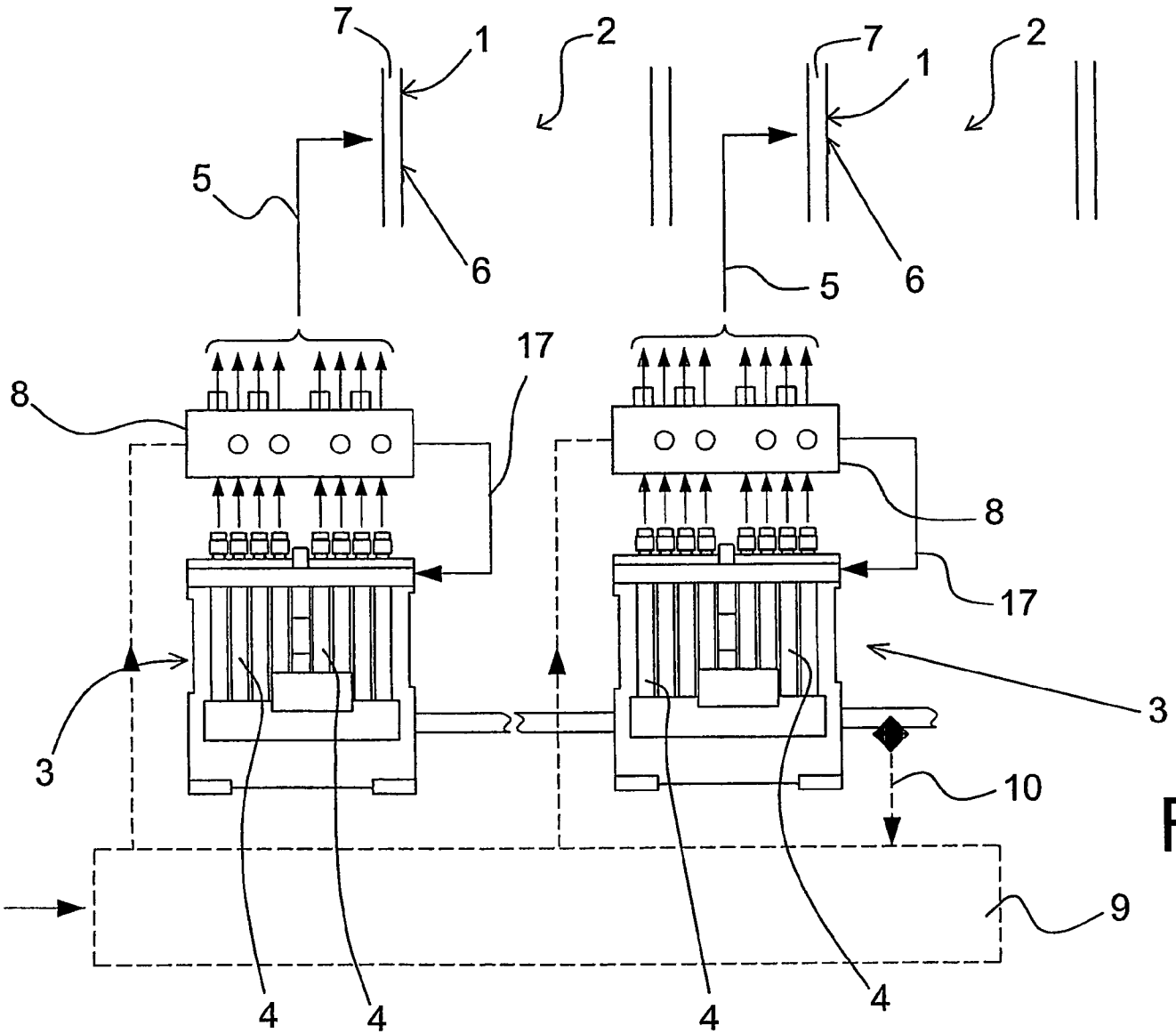
FIG. 1 shows a schematic drawing of an embodiment of an installation according to the invention.

In the Figures of the drawing, identical or corresponding elements will be provided the same designations. No detailed explanation of such details will thus be given in connection with each Figure.

FIG. 1 shows an installation for lubricating cylinder faces 1 in cylinders 2 in large diesel engines. The shown installation includes two lubricating apparatuses 3 that each has a series of piston pumps indicated by 4. Via connecting lines 5 (of which only one is illustrated for each lubricating apparatus), each of the piston pumps are connected with a lubricating point 6 disposed in the cylinder wall 7 for lubricating the cylinder surface 1 of the cylinder wall. The installation furthermore includes a flow regulator 8 which will be explained in more detail with reference to FIG. 2.

Furthermore, the installation includes an electronic control unit 9 which is connected with the flow regulators 8 and the lubricating apparatuses 3. As indicated by 10, the flow regulator can receive an index signal from the lubricating apparatuses 3.

Figure 2:
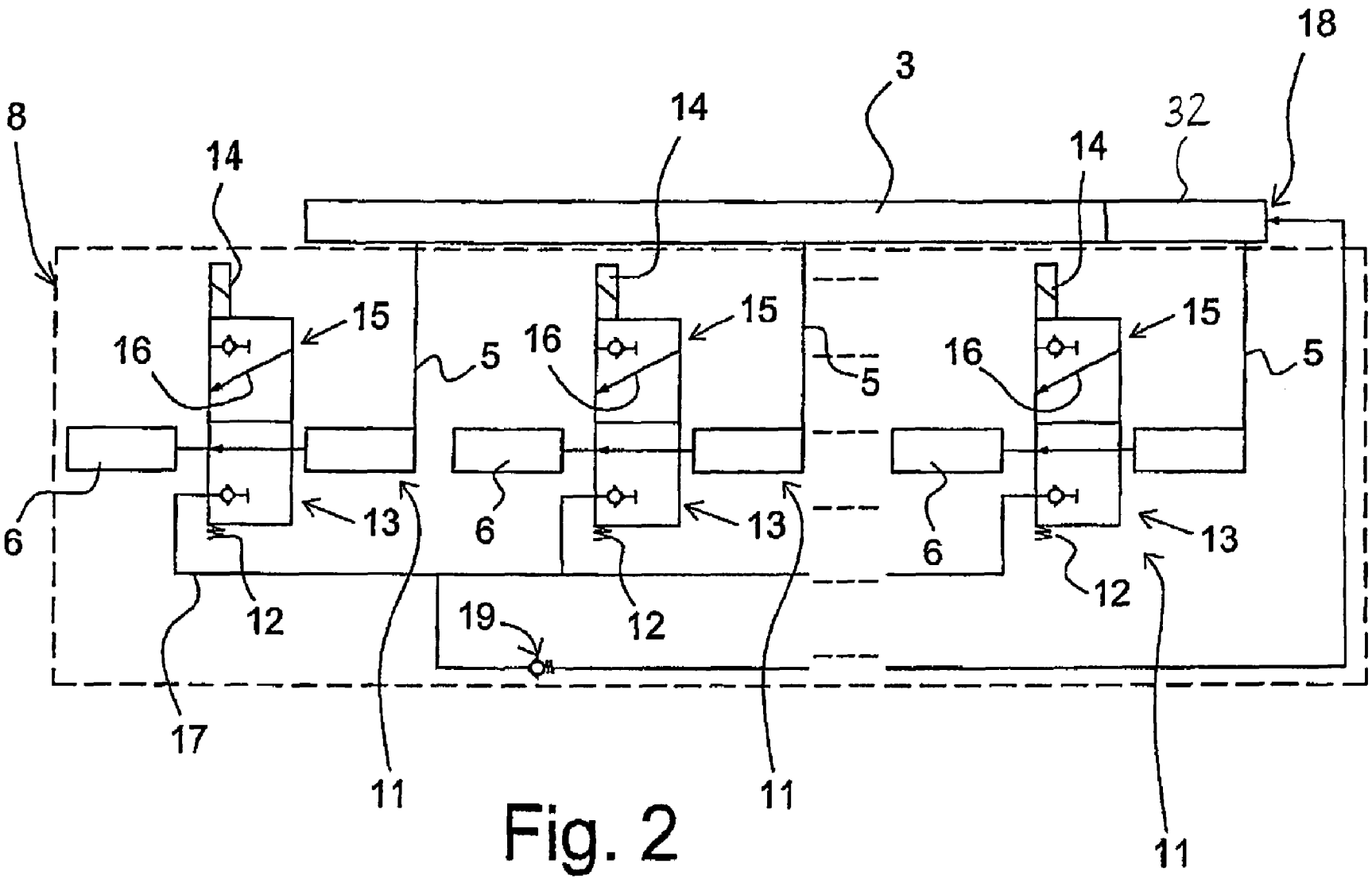
FIG. 2 shows a schematic drawing of an embodiment of redirecting valves in an installation according to the invention.

FIG. 2 shows the schematic drawing of a flow regulator 8. FIG. 2 illustrates three lubricating points 6 and a lubricating apparatus 3. Thus a situation showing three lubricating points in a cylinder can be illustrated.

The flow regulator 8 includes redirecting valves in the shape of electromagnetic valves 11. Electromagnetic valves are inserted in the connecting lines 5 between the lubricating apparatus 3 and an associated lubricating point 6. In the shown situation, the electromagnetic valves 11 are set in their initial position, where a spring 12 is pressed against an extreme position, so that the valve member 13 establishes direct connection between the lubricating apparatus 3 and the lubricating point 6. Each valve 11 has an activation unit 14 which is controlled by the electronic control unit. By activation of the valve, this is displaced against the action of the spring 12 so that the valve member 15 is displaced downwards and disposed in the position assumed by the valve member 13 in FIG. 2. In this situation, a connecting duct 16 in the valve member 15 will connect the connecting line 5 from the lubricating apparatus with a return line 17. The return line 17 is connected with an inlet 18 conducting the lubricating oil back to the lubricating apparatus 3. In the return line 17, a regulating valve/overpressure valve 19 is provided.

Figure 3:
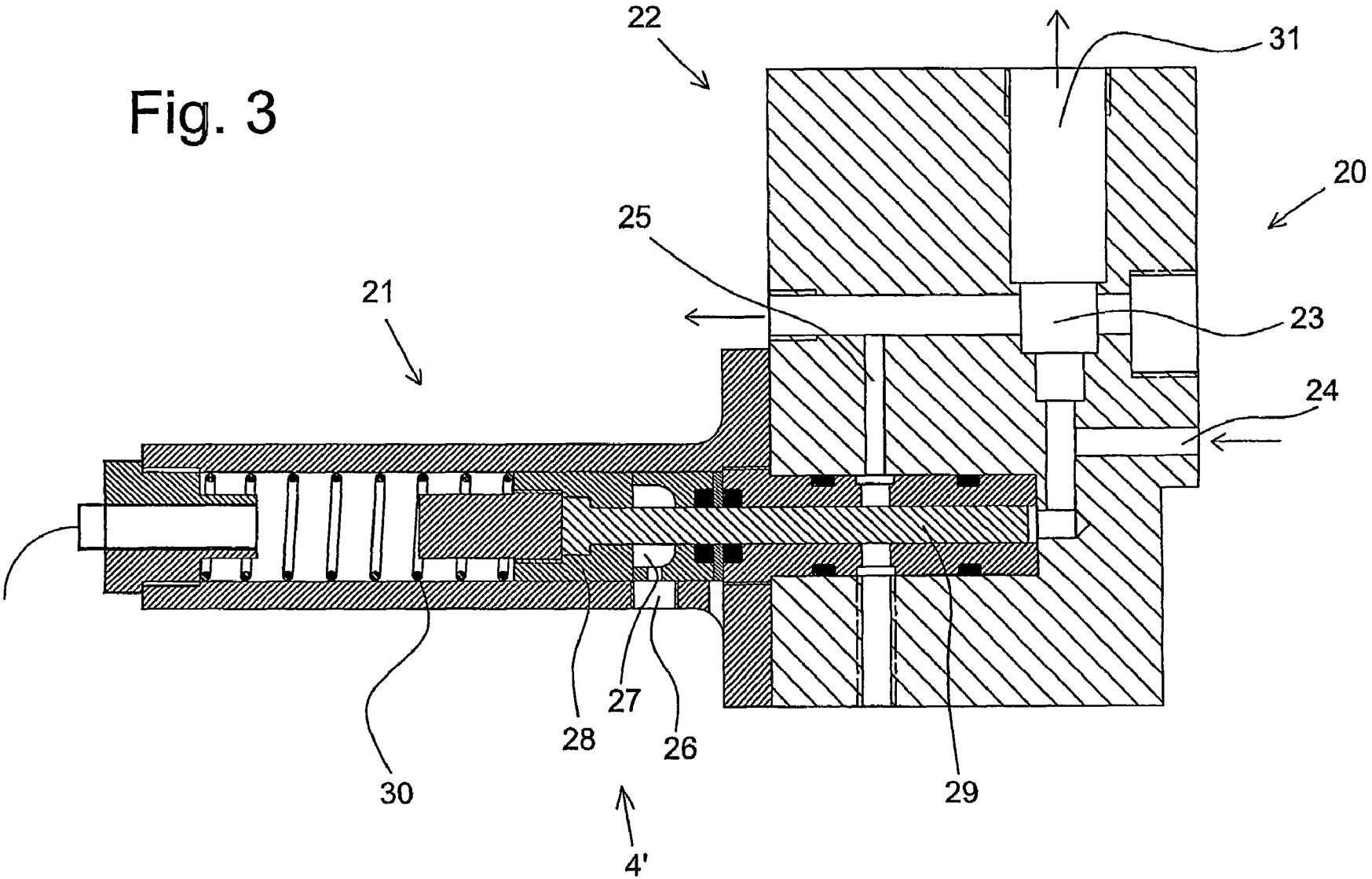
FIG. 3 shows a cross sectional view through a further embodiment for a redirection valve in an installation according to the invention.

FIG. 3 shows the cross sectional view through a further embodiment for a redirection valve 20 which could also be denoted as a flow-switch. This redirection valve 20 will also be connected with an electronic control unit which is not shown in FIG. 3. In this embodiment the redirection valve 20 is integrated with a pump 4'. Due to the integrated construction it is possible to obviate surge in long connecting lines which otherwise might occur when disconnecting the lubricating points.

The redirection valve 20 comprises a switch housing 21 and a pump block 22 which are connected to form a single unit. A pump chamber 23 is connected with a suction channel 24, with a return channel 25 being connected to the return line (not illustrated) and outlet channel 31 connected with the lubricating point (not illustrated). An air port 26 opens into a chamber 27 behind a piston 28 being connected with a slide valve 29 and being loaded by a spring 30 against the illustrated situation for oil passage out through the outlet channel 31.

When pressurised air is supplied through air port 26 the slide valve 29 is urged against the left hand side of the FIG. 3 whereby oil may pass through the return channel 25.

When the air supply is disconnected the spring 30 ensures that the slide valve is again closed whereby the oil will pass through the outlet channel 31 to the lubricating point. Thus the redirection valve 20 has an initial setting where the lubricating oil is conducted to the lubricating point and an activated setting where the lubricating oil is returned to the lubricating apparatus or the lubricating oil reservoir 32 (see FIG. 2).

The supply of pressurised air is controlled by an electronic control unit via suitable valve arrangement.

The advantage obtained through the above mentioned arrangement with a single unit is that the return of lubricating oil to the lubricating apparatus or the lubricating oil reservoir is made in a way that the pressure acting on the outlet of the lubricating apparatus substantially is uninfluenced by the activation of the flow switches/redirection valves. This is e.g. due to the fact that the flow switches/redirection valves is arranged in a position in the lubricating apparatus where it is possible, through the control, to obtain the flow regulation at a very low pressure which is typically between 0 and 2½ bar.

The above embodiments are just a single, not limiting example of the invention. The invention is thus not limited to the shown embodiment but is only limited by the subsequent patent claims.

The invention claimed is:

1. A method for lubricating the cylinder faces in large diesel engines, including at least one lubricating apparatus with a number of piston pumps which via connecting lines are connected with and feed various lubricating points disposed in the walls of the cylinders, characterised in that the lubricating oil portion from a specific pump stroke and to a specific lubricating point is returned to the lubricating apparatus, as an electronic controlled redirecting of the lubricating oil portion between lubricating apparatus and the lubricating points is established.

2. Method according to claim 1, characterised in that the lubricating oil portion is redirected to the lubricating apparatus or to a lubricating oil reservoir.

3. Method according to claim 1, characterised in that lubricating oil is alternately redirected between the various lubricating points in the cylinders which are lubricated by using one or more lubricating apparatuses.

4. Method according to claim 1, characterised in that the controlled feeding of oil from the lubricating apparatus is adjusted so that lubrication without redirection of any lubricating oil portion causes that no under-lubrication occurs by the lubrication of the cylinders.

5. Method according to claim 1, characterised in that the electronically controlled redirecting includes activation of an electromagnetic valve which has an initial setting where the lubricating oil is conducted to the lubricating point, and which by activation is displaced so that the lubricating oil is returned to the lubricating apparatus or to the lubricating oil reservoir.

6. Method according to claim 1, characterised in that redirection of the lubricating oil portion is performed at a time between lubricating strokes of the lubricating apparatus.

7. Method according to claim 6, wherein the redirection is initiated by an index signal coming from a completed contro1led feeding of lubricating oil from the lubricating apparatus.

8. Method according to claim 1, characterised in that the control is performed based on customised regulating algorithms which are contained in an electronic control unit.

9. Method according to claim 1, wherein the diesel engines are marine engines.

10. Installation according to claim 1, wherein the diesel engines are marine engines.

11. An installation for lubricating the cylinder faces in large diesel engines, including at least one lubricating apparatus with a number of piston pumps which via connecting lines are connected with and feed various lubricating points disposed in the walls of the cylinders, characterised in that it includes an electronic control unit which is connected with a flow regulator that includes redirecting valves which are inserted in connecting lines between the lubricating apparatus and the lubricating points.

12. Installation according to claim 11, characterised in that the redirecting valves are connected with return lines connected with the lubricating apparatus or a lubricating oil reservoir.

13. Installation according to claim 11, characterised in that the redirecting valves are provided as electromagnetic valves which may be set in an initial setting where the lubricating oil is conducted to the lubricating point, and an activated setting where the lubricating oil is returned to the lubricating apparatus or the lubricating oil reservoir.

14. Installation according to claim 11, characterised in that the redirecting valves are provided with a pump housing and a channel block which are connected to form a single unit containing a slide valve which has an initial setting where the lubricating oil is conducted to the lubricating point, and an activated setting where the lubricating oil is returned to the lubricating apparatus or the lubricating oil reservoir.

15. Installation according to claim 14, wherein in the activated setting the lubricating oil is returned to the lubricating apparatus or the lubricating oil reservoir through an activation by air.

16. Installation according to claim 14, wherein in the activated setting the lubricating oil is returned to the lubricating apparatus or the lubricating oil reservoir through an activation by a spring.

* * * * *

UNITED STATES PATENT AND TRADEMARK OFFICE

CERTIFICATE OF CORRECTION

PATENT NO. : 7,681,548 B2
APPLICATION NO. : 11/630635
DATED : March 23, 2010
INVENTOR(S) : Jan Aamand It is certified that error appears in the above-identified patent and that said Letters Patent is hereby corrected as shown below:

On the Title page

Item (30) Foreign Application Priority Data should read:

--Jun. 30, 2004 (DK) ..... PA 2004 01035--

Signed and Sealed this

Eighteenth Day of May, 2010

David J. Kappos

David J. Kappos
*Director of the United States Patent and Trademark Office*